United States Patent [19]

Heitz

[11] Patent Number: 4,874,397

[45] Date of Patent: Oct. 17, 1989

[54] COAL GASIFICATION PROCESS

[75] Inventor: Walter L. Heitz, Edwardsville, Ill.

[73] Assignee: Shell Oil Company, Houston, Tex.

[21] Appl. No.: 138,770

[22] Filed: Dec. 29, 1987

[51] Int. Cl.[4] ..... C10J 3/00; C10J 3/84

[52] U.S. Cl. ..... 48/210; 48/202; 48/DIG. 2; 134/20; 252/373

[58] Field of Search ..... 48/202, 203, 206, 209, 48/210, DIG. 2, 87, 77; 585/950; 55/80, 82, 83, 89; 201/2; 252/373; 134/2, 20, 39; 208/48 R, 48 Q; 110/215, 216

[56] References Cited

U.S. PATENT DOCUMENTS 4,054,424 10/1977 Standinger et al. ..... 48/210
4,172,708 10/1979 Wu et al. ..... 48/87

FOREIGN PATENT DOCUMENTS 2718539 11/1977 Fed. Rep. of Germany ..... 48/206
2112015 7/1983 United Kingdom ..... 48/DIG. 2

*Primary Examiner*—Joye Woodard
*Attorney, Agent, or Firm*—Albert J. Adamcik

[57] ABSTRACT

Deposits of flyslag on the walls of a heat exchange zone employed to quench and cool synthesis gas and flyslag particles produced from the gasification of coal may be reduced by (a) temporarily increasing the flow rate of the synthesis gas and flyslag particles during the process to a space velocity of greater than at least 12 meters per second; or (b) after a shutdown or incident where flyslag is deposited, utilizing a space velocity of the synthesis gas and flyslag of greater than 12 meters per second for a time sufficient to remove the deposits, and then utilizing flow rates which prevent or inhibit deposition of flyslag.

4 Claims, No Drawings

COAL GASIFICATION PROCESS

BACKGROUND OF THE INVENTION

In copending application Ser. No. 07/138,771, entitled "Process for Prevention of Flyslag Deposits" by P. L. Zuideveld, attorney docket No. K-7631, filed even date herewith, and incorporated herein by reference, there is described a process for prevention or inhibition of deposits of flyslag particles on the surfaces of a heat exchange zone or equipment employed in cooling synthesis gas and flyslag particles produced from the gasification of coal or similar carbonaceous materials. Notwithstanding the practice of that invention, deposits of flyslag may occur on the heat exchange surfaces, for a variety of reasons. For example, on start-up of the process, before the required superficial velocities of the synthesis gas and flyslag particles are obtained, deposits may occur. If there are interruptions in the process flows, shutdown, or variations due to turndown of the gasification reaction, some deposition may occur. Accordingly, a procedure which may remove these deposits without interruption of the process might have great economic value. The invention concerns such a procedure.

SUMMARY OF THE INVENTION

Accordingly, in one embodiment the invention relates to a process for the gasification of coal or similar carbonaceous material comprising (a) oxidizing particulate coal under conditions to produce synthesis gas at a temperature of from about 1050° C. to about 1800° C. containing molten flyslag particles; (b) passing said synthesis gas to a heat exchange zone having walls cooler than the melting point of said flyslag particles, and quenching and cooling said synthesis gas and solidifying said flyslag particles in said heat exchange zone, the superficial velocity of the synthesis gas and flyslag particles being maintained at a rate of from about 4 meters per second to about 12 meters per second, preferably about 6 meters per second to about 12 meters per second, (c) increasing the rate of flow of the synthesis gas and flyslag particles through said heat exchange zone to a rate greater than about 12 meters per second for a time sufficient to reduce deposits present on the walls of said heat exchange zone, and (d) resuming the flow of the synthesis gas and flyslag particles through said heat exchange zone at a rate of from about 4 meters per second, preferably 6 meters per second, to bout 12 meters per second. It has been determined that, at superficial space velocities greater than about 12 meters per second, a "scouring" effect occurs on the heat exchange surfaces, thereby cleaning deposits from them. The "scouring" is continued only long enough to remove the deposits, so that severe erosion of the heat exchange surfaces does not occur.

In another embodiment, the superficial velocities of the synthesis gas and flyslag particles may be temporarily raised on startup to a rate greater than about twelve meters per second, and then lowered to a rate of from about 6 meters per second to about 12 meters per second for the normal running of the process.

DETAILED DESCRIPTION OF THE INVENTION

The partial combustion of coal to produce synthesis gas, which is essentially carbon monoxide and hydrogen, and particulate flyslag, is well known, and a survey of known processes is given in "Ullmanns Enzyklopadie Der Technischen Chemie", vol. 10 (1958), pp. 360–458. Several such processes for the preparation of hydrogen and carbon monoxide, flyslag-containing gases are currently being developed. Accordingly, details of the gasification process are related only insofar as is necessary for understanding of the present invention.

In general, the gasification is carried out by partially combusting the coal with a limited volume of oxygen at a temperature normally between 800° C. and 2000° C. If a temperature of between 1050° C. and 2000° C. is employed, the product gas will contain very small amounts of gaseous side products such as tars, phenols and condensable hydrocarbons as well as molten flyslag particles and salts. Suitable coals include lignite, bituminous coal, sub-bituminous coal, anthracite coal, and brown coal. Lignites and bituminous coals are preferred. In order to achieve a more rapid and complete gasification, initial pulverization of the coal is preferred. Particle size is preferably selected so that 70% of the solid coal feed can pass a 200 mesh sieve. The gasification is preferably carried out in the presence of oxygen and steam, the purity of the oxygen preferably being at least 90% by volume, nitrogen, carbon dioxide and argon being permissible as impurities. If the water content of the coal is too high, the coal should be dried before use. The atmosphere will be maintained reducing by the regulation of the weight ratio of the oxygen to moisture and ash free coal in the range of 0.6 to 1.0, preferably 0.8 to 0.9. The specific details of the equipment and procedures employed form no part of the invention, but those described in U.S. Pat. Nos. 4,350,103 and 4,458,607, both incorporated herein by reference, may be employed. Although, in general, it is preferred that the ratio between oxygen and steam be selected so that from 0 to 1.0 parts by volume of steam is present per part by volume of oxygen, the invention is applicable to processes having substantially different ratios of oxygen to steam. The oxygen used is preferably heated before being contacted with the coal, preferably to a temperature of from about 200° to 500° C.

The details of the gasification reactor system form no part of the present invention, and suitable reactors are described in U.S. Pat. Nos. 4,202,672 and 4,022,591. The high temperature at which the gasification is carried out is obtained by reacting the coal with oxygen and steam in a reactor at high velocity. A preferred linear velocity of injection is from 10 to 100 meters per second, although higher or lower velocities may be employed. The pressure at which the gasification can be effected may vary between wide limits, preferably being from 1 to 200 bar. Residence times may vary widely; common residence times of from 0.2 to 20 seconds are described, with residence times of from 0.5 to 15 seconds being preferred.

After the starting materials have been converted, the reaction product, which comprises hydrogen, carbon monoxide, carbon dioxide, and water, as well as the aforementioned impurities, is removed from the reactor. This gas, which normally has a temperature between 1050° C. and 1800° C., contains the impurities mentioned and flyslag, including carbon containing solids. In order to permit removal of these materials and impurities from the gas, the reaction product stream should be first quenched and cooled. A variety of elaborate techniques have been developed for quenching and cooling the gaseous stream, the techniques in general being characterized by use of a quench gas and a boiler in which steam is generated with the aid of the waste heat. The walls of the quench zone, i.e., the external or wall surfaces not in contact with the synthesis gas, and those of the primary heat exchange zone, are cooled with boiling water r steam and, as indicated, may collect deposits of flyslag.

In accordance with the first embodiment of the invention, the flow of the synthesis gas and flyslag is maintained at a space velocity of from about 6 meters per second to about 12 meters per second. When it is determined that deposits are present on the cooling surfaces in the heat exchange zone, for example, by a change in heat transfer rates or by increased pressure drop across the zone, the superficial velocity of the synthesis gas and flyslag particles is increased for a time necessary to decrease or remove the deposits. Preferably, the superficial velocity will be increased to a range of about 14 meters per second to about 24 meters per second, most preferably from about 14 meters per second to about 20 meters per second. The time needed will vary, depending on the depths of the deposits, and, accordingly, a precise time for the flow rate increase cannot be given. Removal of the deposits, and thus the time required for increased flow rate, may be determined, in a given case, e.g., by noting the decrease in pressure drop across the heat exchange zone, or by X-ray measurements.

What is claimed is:

1. A process for the gasification of coal comprising (a) oxidizing particulate coal under conditions to produce synthesis gas and producing synthesis gas at a temperature of from about 1050° C. to about 1800° C. containing molten flyslag particles;

(b) passing said synthesis gas and molten flyslag particles to a heat exchange zone having walls cooler than the melting point of said flyslag particles, quenching and cooling said synthesis gas and solidifying said flyslag particles in said heat exchange zone during which flyslag deposits are formed on said walls, the superficial velocity of the synthesis gas and flyslag particles passing through said heat exchange zone being maintained at a rate of from about 4 meters per second to about 12 meters per second;

(c) increasing the rate of flow of the synthesis gas and flyslag particles through said heat exchange zone to a rate greater than about 12 meters per second for a time sufficient to reduce the flyslag deposits present on the walls of said heat exchange zone; and (d) resuming the flow of the synthesis gas and flyslag particles through said heat exchange zone at a rate of from about 4 meters per second to about 12 meters per second.

2. The process of claim 1 wherein the coal employed is lignite.

3. A process for the gasification of coal comprising (a) oxidizing particulate coal under conditions to produce synthesis gas at a temperature of from about 1050° C. to about 1800° C. containing molten flyslag particles;

(b) passing said synthesis gas and molten flyslag particles to a heat exchange zone having walls cooler than the melting point of said flyslag particles and having flyslag deposits thereon, quenching and cooling said synthesis gas and solidifying said flyslag particles in said heat exchange zone, the superficial velocity of said synthesis gas and flyslag particles passing through said heat exchange zone being maintained at a rate of greater than about 12 meters per second for a time sufficient to reduce the deposits present on said walls; and (c) decreasing the flow rate of said synthesis gas and flyslag particles through said heat exchange zone to a superficial velocity of from about 4 meters per second to about 12 meters per second.

4. The process of claim 3 wherein the coal employed is lignite.

* * * * *